US006062032A

United States Patent [19]

Yoon

[11] Patent Number: 6,062,032

[45] Date of Patent: May 16, 2000

[54] CONDENSED WATER DRAIN TRAY OF AIR CONDITIONER

[75] Inventor: Yeon-Seob Yoon, Suwon, Rep. of Korea

[73] Assignee: Samsung Electronics Co., Ltd., Suwon, Rep. of Korea

[21] Appl. No.: 09/208,584

[22] Filed: Dec. 10, 1998

[30] Foreign Application Priority Data

Dec. 15, 1997 [KR] Rep. of Korea ..... 97-68904

[51] Int. Cl.[7] ..... F25D 21/14

[52] U.S. Cl. ..... 62/285; 62/212

[58] Field of Search ..... 62/285, 288, 298, 62/272, 291

[56] References Cited

U.S. PATENT DOCUMENTS

| | | | |
|---|---|---|---|
| 2,134,003 | 10/1938 | Morrison | 62/291 |
| 2,158,447 | 5/1939 | Whitsett | 62/291 |
| 3,524,328 | 8/1970 | Schuster | 62/385 |
| 4,416,327 | 11/1983 | Nakada et al. | 165/122 |

FOREIGN PATENT DOCUMENTS

| | | | |
|---|---|---|---|
| 54-71843 | 8/1979 | Japan | 62/285 |
| 60-213747 | 10/1985 | Japan | 62/285 |

*Primary Examiner*—Henry Bennett
*Assistant Examiner*—Melvin Jones
*Attorney, Agent, or Firm*—Burns, Doane, Swecker & Mathis, L.L.P.

[57] ABSTRACT

An air conditioner includes a housing including a front panel and a rear panel. A heat exchanger is disposed within the housing and includes a front portion disposed adjacent the front panel, and a rear portion disposed adjacent the rear panel. A lower drain tray is positioned beneath the front portion of the heat exchanger for collecting and draining away condensed water falling therefrom. An upper drain tray is positioned beneath the rear portion of the heat exchanger for collecting and draining away condensed water falling therefrom. The upper drain tray is of integrally molded construction with the rear panel, whereby no gaps are present therebetween.

6 Claims, 4 Drawing Sheets

CONDENSED WATER DRAIN TRAY OF AIR CONDITIONER

BACKGROUND OF THE INVENTION

1. Field of the Invention

The present invention relates to an air conditioner, and more particularly to an upper water disposal apparatus adapted to conduct condensed water generated from a rear portion of a heat-exchanger.

2. Description of the Prior Art

Generally, an air conditioner is divided into an integral type air conditioner and a separation type air conditioner according to construction of units. The air conditioner is divided into an exclusive cooling type, an exclusive cooling and dehumidifying type and a cooling and hearing dual-purpose type according to functions thereof.

In the cooling and heating dual-purpose type air conditioner, an indoor unit and an outdoor unit are operated in one system and can be operated for heating and cooling purpose according to necessity thereof.

In the conventional separation type air conditioner, an indoor unit body 10, as illustrated in FIG. 1, includes a front panel 20 and a rear panel 30 to form a housing.

The front panel 20 is provided with a front grille 40, a discharge outlet 50 and up/down air direction control means 60. The front panel 20 is provided therein with an air filter 70, a heat exchanger 80 and a blower 90.

The discharge outlet 50 includes a plurality of horizontal air direction control means 100, a lower drain tray 110 and an upper drain tray 120 mounted to the rear panel 30. The lower drain tray 110 is positioned beneath a front portion 80A of the heat exchanger, and the upper drain tray 120 is positioned beneath a rear portion 80B of the heat exchanger.

Reference numerals 21 and 41 designate suction inlets.

However, there is a problem in an upper condensed water disposal apparatus in an air conditioner thus constructed in that gaps are always generated between the upper drain tray 120 and the rear panel 30 due to shrinkage of injection moldings and improper dimensions, thereby resulting in leakage of the condensed water through the gaps.

SUMMARY OF THE INVENTION

The present invention is disclosed to solve the aforementioned problem and it is an object of the present invention to provide an upper condensed water drain tray of an air conditioner which is integrally molded to a rear panel for the elimination of gaps therebetween.

In accordance with the object of the present invention, there is provided an air conditioner comprising a housing. A heat exchanger is disposed within the housing and includes first and second portions. A first drain tray is positioned beneath the first portion of the heat exchanger for collecting and draining-away condensed water falling therefrom. A second drain tray is disposed at a higher elevation than the first drain tray and is positioned beneath the second portion of the heat exchanger for collecting and draining away condensed water falling therefrom. The second drain tray is of integrally molded construction with a wall of the housing whereby no gaps are present therebetween.

BRIEF DESCRIPTION OF THE DRAWINGS

For a fuller understanding of the nature and objects of the invention, reference should be made to the following detailed description taken in conjunction with the accompanying drawings in which.

DETAILED DESCRIPTION OF A PREFERRED EMBODIMENT OF THE INVENTION

Figure 1:
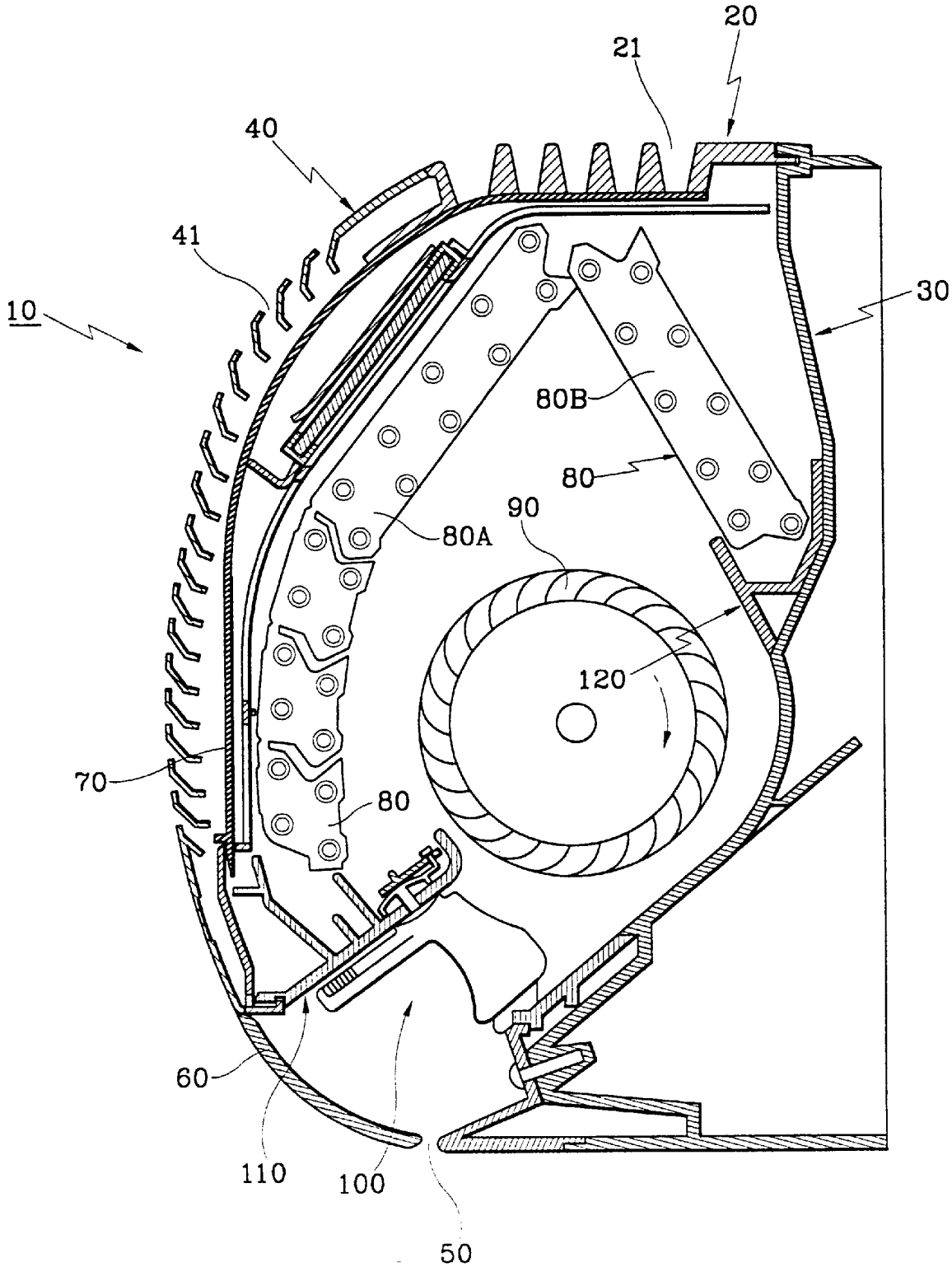
FIG. 1 (PRIOR ART)
FIG. 1 is a schematic diagram of an indoor unit for illustrating a condensed water disposal structure at a centrally upper side of a multivending type heat-exchanger according to the prior art.

The preferred embodiment of the present invention will now be described in detail with reference to the accompanying drawings.

Throughout the drawings, like reference numerals and symbols are used for designation of like or equivalent parts and portions as in the prior art for simplicity of illustration and explanation.

Figure 2:
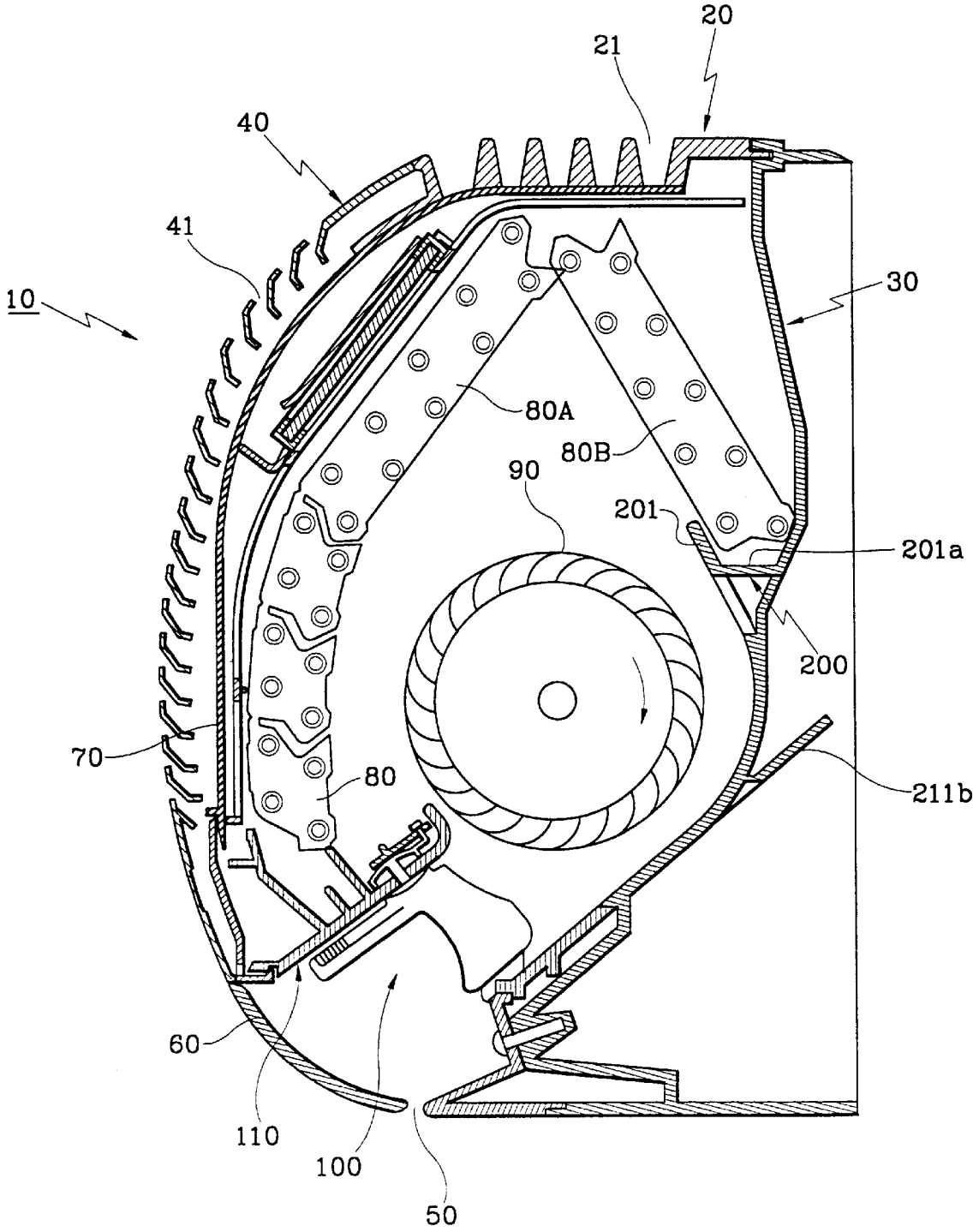
FIG. 2 is a schematic overall diagram of an indoor unit for illustrating a condensed water disposal structure at a centrally upper side of a multivending heat-exchanger according to the present invention.
Figure 3:
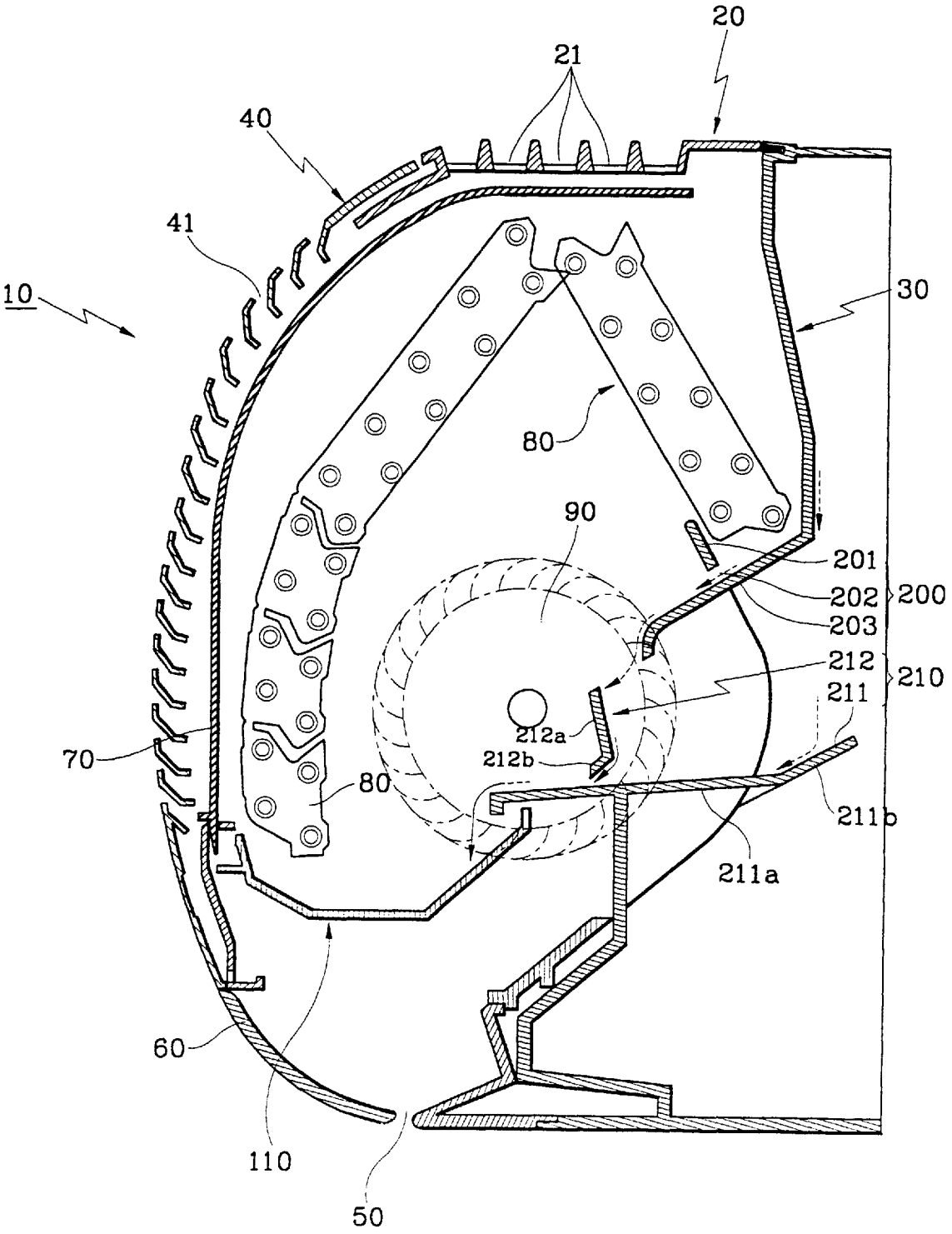
FIG. 3 is a schematic overall diagram of an indoor unit for illustrating a condensed water disposal structure at an upper left side of a multi-vending heat-exchanger according to the present invention.
Figure 4:
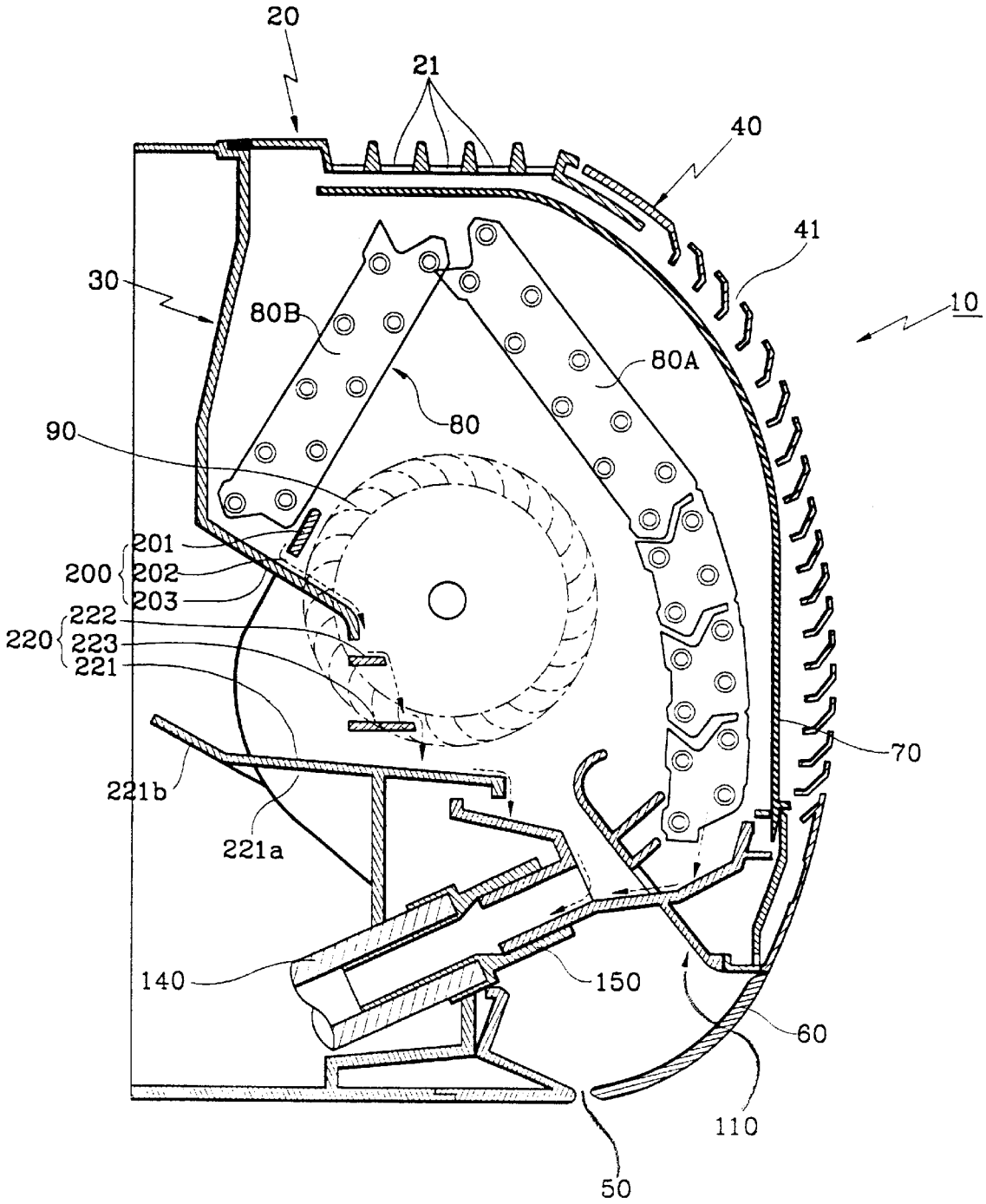
FIG. 4 is a schematic overall diagram of an indoor unit for illustration a condensed water disposal structure at an upper right side of a multi-vending heat-exchanger according to the present invention.

The upper condensed water disposal apparatus according to the present invention includes, as illustrated in FIGS. 2, 3 and 4, an upper drain tray 200 integrally injection-molded with an inner surface of the rear panel 30, along with integral first and second water flow guides 210 and 220.

In other words, the upper drain tray 200 comprises an overflow prevention sill 201 integrally molded with a floor 203 which is integrally molded with the rear panel 30. The sill is upwardly and forwardly protruding at a predetermined slant from the floor 203 in order that the rear portion 80B of the multi-sectional heat-exchanger 80 is not contacted thereto.

Drainage openings 202 are disposed at both left and right ends of the overflow prevention sill 201 so that condensed water collected in the overflow prevention sill 201 can be forwardly guided and drained toward the lower drain tray 110 along an inclined portion 203.

The first water flow guide 210 is integrally formed underneath the upper drain tray 200 with a drain tray plate 211 for guiding the condensed water collected at the overflow prevention sill 201 to the lower drain tray 110 and for gathering the condensed water (dew) generated by a temperature difference on an outside wall of the rear panel 30 to guide same to the lower drain tray 110.

A water splash prevention plate 212 is integrally formed between the drain plate 211 and the upper drain tray 200 to prevent the condensed water from splashing out of the drain plate 211.

At this time, the first drain plate 211 is formed with a first inclined portion 211*a* to facilitate flow of the condensed water to the lower drain tray 110, and at the rear end of the first inclined portion 211*a* there is formed a second inclined portion 211*b* which is steeper in slant than that of the first inclined portion 211*a* to enable the condensed water to be completely collected inside.

A vertically inclined portion 212*a* extends from an intermediate height of the water splash prevention plate 212 to an uppermost end thereof to slow a flow speed of the condensed water exiting the inclined portion 203. Extending from the intermediate height of the water splash prevention plate 212 and a lowermost end thereof is an integrally formed horizontal inclined portion 212*b* to guide the condensed water to a lower water level.

The second water flow guide 220 serves to guide the condensed water to the lower drain tray 110 and is integrally formed underneath the upper drain tray 200 with a drain tray plate 221 for guiding the condensed water (dew), generated by a temperature difference at the outside wall of the rear panel 30, to the lower drain tray 110.

Between the drain plate 221 and the upper drain tray 200 there are integrally formed first and second water splash prevention plates 222 and 223 to allow the condensed water to drop softly in multi-stages.

At this time, the drain plate 221 is formed with a first inclined portion 221*a* at a predetermined slant to allow the condensed water to easily flow to the lower drain tray 110, and a second inclined portion 221*b* is formed behind the first inclined portion 221*a* which is steeper in slant than the first inclined portion 221*a* to completely collect the condensed water flowing down the outside wall of the rear panel 30.

The first water splash prevention plate 222 is horizontally disposed underneath the inclined portion 203 to slow the flow speed of the condensed water received therefrom. The second water splash prevention plate 223 is horizontally mounted beneath the first water splash prevention plate 222 to slow the flow speed of the condensed water. A rear end of the second water splash prevention plate 223 is situated on the same vertical line as the rear end of the first water splash prevention plate 222 and protrudes farther forwardly than the first water splash prevention plate 222 to thereby make the plate 223 wider than the first water splash prevention plate 222.

Reference numeral 140 is a drainage hose connected to one side of the lower drain tray 110 via a connecting member 150 for draining the collected condensed water outside of the indoor unit body 10.

Now, the operational effect of the present invention thus constructed will be described.

As illustrated in FIG. 2, when an electric power is applied to the air conditioner by manipulation of a remote controller, the blower 90 in the indoor unit body 10 is rotated. The room air is sucked through the front panel 20 by the force of the blower 90 via the plurality of suction inlets 41 and is filtered by air filters 70 mounted at the rear of the suction inlets 21 and 41.

The filtered air is heat exchanged into cool air after passing through the heat exchanger 80.

At this time, the heat-exchanged air is discharged into the room and is guided to a desired place in the room to thereby cool the room to a low temperature.

As the sucked air is heat exchanged to cold air by a temperature difference between the refrigerant temperature and the sucked air, condensed water is generated on the surface of the heat-exchanger and gravitates thereon. At this time, the condensed water dropping from the left side of the heat-exchanger 80 is collected on the upper surface of the lower drain tray 110, as is apparent from FIG. 2, and the condensed water dropping from the right side of the heat-exchanger 80 is collected on the upper surface of the upper drain tray 200.

The condensed water collected in the upper drain tray 200 flows either to the left or right side of the upper drain tray 200 according to the inclines of the overflow prevention sill 201 and a floor 201*a* of the tray 200. When the condensed water flows to the left side, as illustrated in FIG. 3, the condensed water flows forward via the drainage opening 202 and the inclined portion 203 and drops against the vertical incline 212*a* to thereby be reduced in flow speed. The condensed water flowing on the vertically inclined portion 212*a* is abruptly changed to a forward flow direction by the horizontally inclined portion 212*b* integrally formed beneath the inclined portion 212*a* to be reduced in flow speed again and drop onto the drain plate 211 in low water level.

The drain plate 211 collects all the condensed water flowing from the upper drain tray 200 and the splash prevention sill 212 and the condensed water generated by the temperature difference at the external wall of the rear panel 30. The drain plate 211 also serves to conduct the condensed water forwardly to the lower drain tray 110 connected to the drain plate 211.

However, when the condensed water collected in the upper drain tray 200 flows to the right, as illustrated in FIG. 4, it flows forward through another drainage opening 202, drops onto the first water splash prevention plate 222 to thereby be reduced in speed. The condensed water flowing from the first water splash prevention plate 222 drops onto the second water splash prevention plate 223 to become drastically reduced in speed and to be dropped to a lower water level toward the drain plate 221.

Successively, the drain plate 221 collects all of the condensed water from the drain tray 200, the first and second water splash prevention plates 222 and 223 and that from the rear panel 30, and simultaneously serves to conduct the condensed water forwardly to the drain plate 221 and to the lower drain tray 110 connected thereto.

Here, the upper drain tray 200 is integrally injection-molded with the inner wall of the rear panel, thereby preventing the formation of a gap therebetween that occurs in the prior art when a separate drain tray is coupled to the rear panel 30 as shown in FIG. 1. Hence, the potential for water leakage through such a gap is prevented.

Furthermore, because the water splash prevention plates 212, 222 and 223 are so arranged as to minimize a drop height, the condensed water is significantly reduced in splash force while dropping from the upper drain tray 200 to the drain plates 211 and 221, thereby preventing the leakage outside of the rear panel 30 and facilitating a complete drainage toward the front side of the rear panel 30.

Meanwhile, the condensed water gathered in the drain tray 200 enters the drainage hose 140 connected to one end of the lower drain tray 110 via the connecting member 150 to be drained outside of the indoor unit body 10.

As is apparent from the foregoing, there is an advantage in the upper condensed water disposed apparatus of an air conditioner according to the present invention, in that when a rear panel is injection-molded of plastic, an upper drain tray is integrally formed at a predetermined height in an inner wall thereof, such that a prior art coupling gap is eliminated to thereby prevent water leakage.

Although the present invention has been described in connection with a preferred embodiment thereof, it will be appreciated by those skilled in the art that additions, deletions, modifications, and substitutions not specifically described may be made without departing from the spirit and scope of the invention as defined in the appended claims.

What is claimed is:

1. A condensed water drain tray of an air conditioner comprising:

an indoor unit body;

a first portion and a second portion of the heat exchanger disposed within the indoor unit body;

a lower drain tray positioned beneath the first portion of the heat exchanger for collecting and draining-away condensed water received therefrom; and a upper drain tray disposed at a higher elevation than the lower drain tray and positioned beneath the second portion of the heat exchanger for collecting and draining-away condensed water received therefrom, the upper drain tray being of integrally molded construction with a wall of the indoor unit body whereby no gaps are present between the upper drain tray and the wall.

2. The condensed water drain tray according to claim 1 wherein the first portion of the heat exchanger constitutes a front portion disposed adjacent a front panel of the indoor unit body, and the second portion of the heat exchanger constitutes a rear portion disposed adjacent a rear panel of the indoor unit body which forms the wall.

3. The condensed water drain tray according to claim 2 wherein the upper drain tray includes a generally horizontal floor and a overflow prevention sill extending upwardly from a front portion of the floor.

4. The condensed water drain tray according to claim 3 wherein the overflow prevention sill is spaced from the rear portion of the heat exchanger.

5. The condensed water drain tray according to claim 4 wherein drainage openings are formed between the overflow prevention sill and the floor at opposite ends of the upper drain tray for conducting condensed water, the floor being forwardly and downwardly inclined so that the condensed water flows forwardly and downwardly through the drainage openings.

6. The condensed water drain tray according to claim 3 including a water-conducting structure for conducting water from the floor to the lower drain tray.

* * * * *